US006290178B1

(12) United States Patent
Wang

(10) Patent No.: US 6,290,178 B1
(45) Date of Patent: Sep. 18, 2001

(54) INTERNAL SUPPORT STRUCTURE FOR A KITE

(75) Inventor: Jung-Yuan Wang, Mississauga (CA)

(73) Assignee: Itemax International Inc., Mississauga (CA)

( * ) Notice: Subject to any disclaimer, the term of this patent is extended or adjusted under 35 U.S.C. 154(b) by 0 days.

(21) Appl. No.: 09/464,073

(22) Filed: Dec. 16, 1999

(51) Int. Cl.[7] ..... B64C 31/06
(52) U.S. Cl. ..... 244/153 R; 244/154
(58) Field of Search ..... 244/153 R, 154; D21/445

(56) References Cited

U.S. PATENT DOCUMENTS

| | | | |
|---|---|---|---|
| D. 407,126 | | 3/1999 | Wang . |
| D. 428,451 | * | 7/2000 | Wang . |
| D. 432,187 | * | 10/2000 | Wang . |
| 671,865 | * | 4/1901 | Mowrer . |
| 2,394,366 | * | 2/1946 | Chu et al. . |
| 2,827,252 | * | 3/1958 | Pohl . |
| 3,092,359 | * | 6/1963 | Pohl . |
| 3,098,634 | * | 7/1963 | Finklea . |
| 3,193,224 | * | 7/1965 | Williamson . |
| 3,711,045 | * | 1/1973 | Holland . |
| 4,150,804 | * | 4/1979 | Jackson . |
| 4,830,313 | * | 5/1989 | Cheng . |

FOREIGN PATENT DOCUMENTS

4302863 * 8/1994 (DE) ..... 244/153 R

OTHER PUBLICATIONS

Itemax International Inc.—Kite Biplane V packaging dated 1997.

* cited by examiner

*Primary Examiner*—Charles T. Jordan
*Assistant Examiner*—Tien Dinh
(74) *Attorney, Agent, or Firm*—Bereskin & Parr

(57) ABSTRACT

An improved shape-retaining support structure is provided for the fuselage of a windsock style kite. An inextensible strap member is also provided between the wings of the kite to transfer wing loads through the windsock body without distorting its shape.

20 Claims, 11 Drawing Sheets

INTERNAL SUPPORT STRUCTURE FOR A KITE

FIELD OF THE INVENTION

The invention relates to toy kites and, in particular, to an internal support structure for a windsock kite.

BACKGROUND OF THE INVENTION

It is known in the art to provide a kite with a windsock-like body, as shown in U.S. Pat. No. D407,126 to Wang. This design patent discloses a kite having an airplane configuration, wherein the airplane kite K comprises (referring to FIG. 1) a windsock body element B which is generally cylindrically-shaped, wings W, and a tail T. Wings W are supported by semi-rigid or rigid cross-beam rods C and the windsock body B is supported internally by one or more semi-rigid or rigid rods R. Referring to FIG. 2, a pair of rods R are positioned lengthwise through the windsock body B. These rods R are slightly longer than the length of windsock body B and are crossed to form an X-shape to provide stability and support to windsock body B. Rods R are retained at their respective ends by a plurality of pockets P, with the ends of each rod R touching opposite sides of the windsock body.

A difficulty is encountered in such designs in providing an internal support structure which can simply but effectively maintain the open cross-sectional shape of the windsock body in spite of the tensile stresses placed on the kite body by the internal rods and the wing cross-beams. The lengthwise stresses provided by the internal support rods tends to flatten the cylindrical cross-section of the windsock and, likewise, the transverse or lateral tension induced by the wing cross-beam also tends to locally flatten the windsock. It has been found that the configuration of the rods R in FIG. 2 is somewhat unstable and, further, does not adequately fill out the windsock shape, resulting in a somewhat limp or wrinkled appearance to the windsock body.

Accordingly, there is a need of an internal support structure for a windsock-like kite which overcomes these and other problems of prior art kites.

SUMMARY OF THE INVENTION

The present invention provides in one aspect a kite comprising a fabric sleeve having a leading end, a trailing end and a generally longitudinal axis extending from the leading end to the trailing end, at least one wing member mounted to the sleeve, at least two resilient rods, each of the rods having a leading end and a trailing end, and a plurality of rod retainers for retaining the rods so that the rods add support to the sleeve, the rods, when retained in the rod retainers, having a curved configuration and extending generally longitudinally of the sleeve, wherein each rod contacts the sleeve at at least one region between the sleeve leading end and the sleeve trailing end, and wherein the rods intersect, at least twice, at least one plane defined by the general longitudinal axis and extending between the respective first ends of the rods.

In a second aspect, the present invention provides a kite comprising a fabric sleeve, at least one wing member mounted to the sleeve, at least two resilient rods for internally supporting the sleeve, and a plurality of rod retainers for retaining the rods interior of the sleeve in a curved condition, wherein the rods, when retained in the retainers, substantially intersect at least twice.

In a third aspect, the present invention provides a kite comprising a fabric sleeve having a leading end and a trailing end, at least one wing member mounted to the sleeve, at least a first and second resilient rods, each of the rods having a leading end and a trailing end, and a plurality of rod retaining members for retaining the rods in the sleeve, the rods, when retained in the rod retainers, having a curved configuration and extending generally longitudinally of the sleeve, wherein a vector defined from the leading end of the first rod to the leading end of the second rod has substantially the same direction as a vector defined from the trailing end of the first rod to the trailing end of the second rod.

BRIEF DESCRIPTION OF THE DRAWINGS

For a better understanding of the present invention, and to show more clearly how it may be carried into effect, reference will now be made by way of example to the accompanying drawings.

The drawings show articles made according to a preferred embodiment of the present invention, in which.

DETAILED DESCRIPTION OF THE PREFERRED EMBODIMENT

Figure 1:
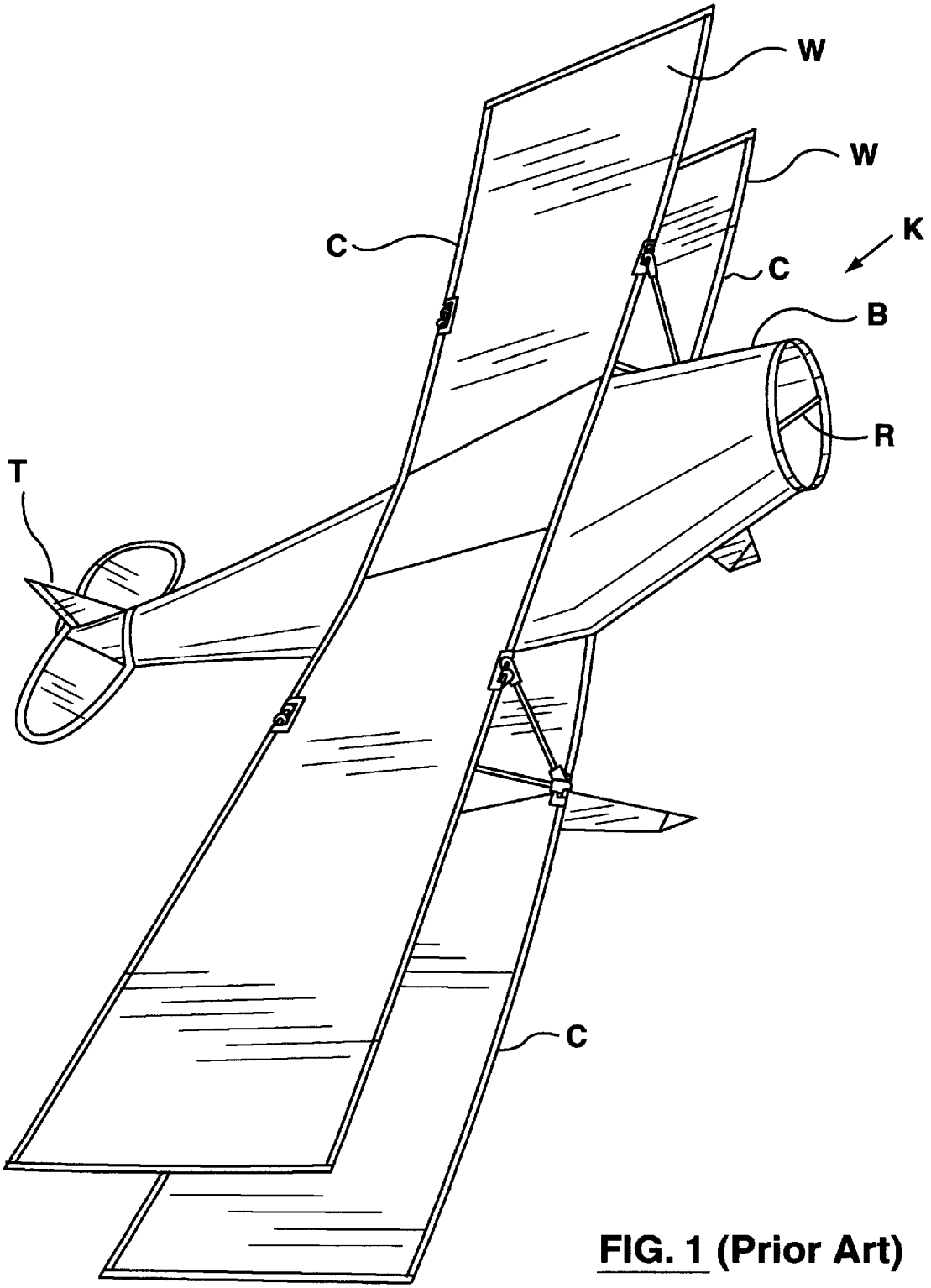
FIG. 1 (Prior Art)
FIG. 1 is an isometric view from the front and to one side of a kite according to the prior art.
Figure 2:
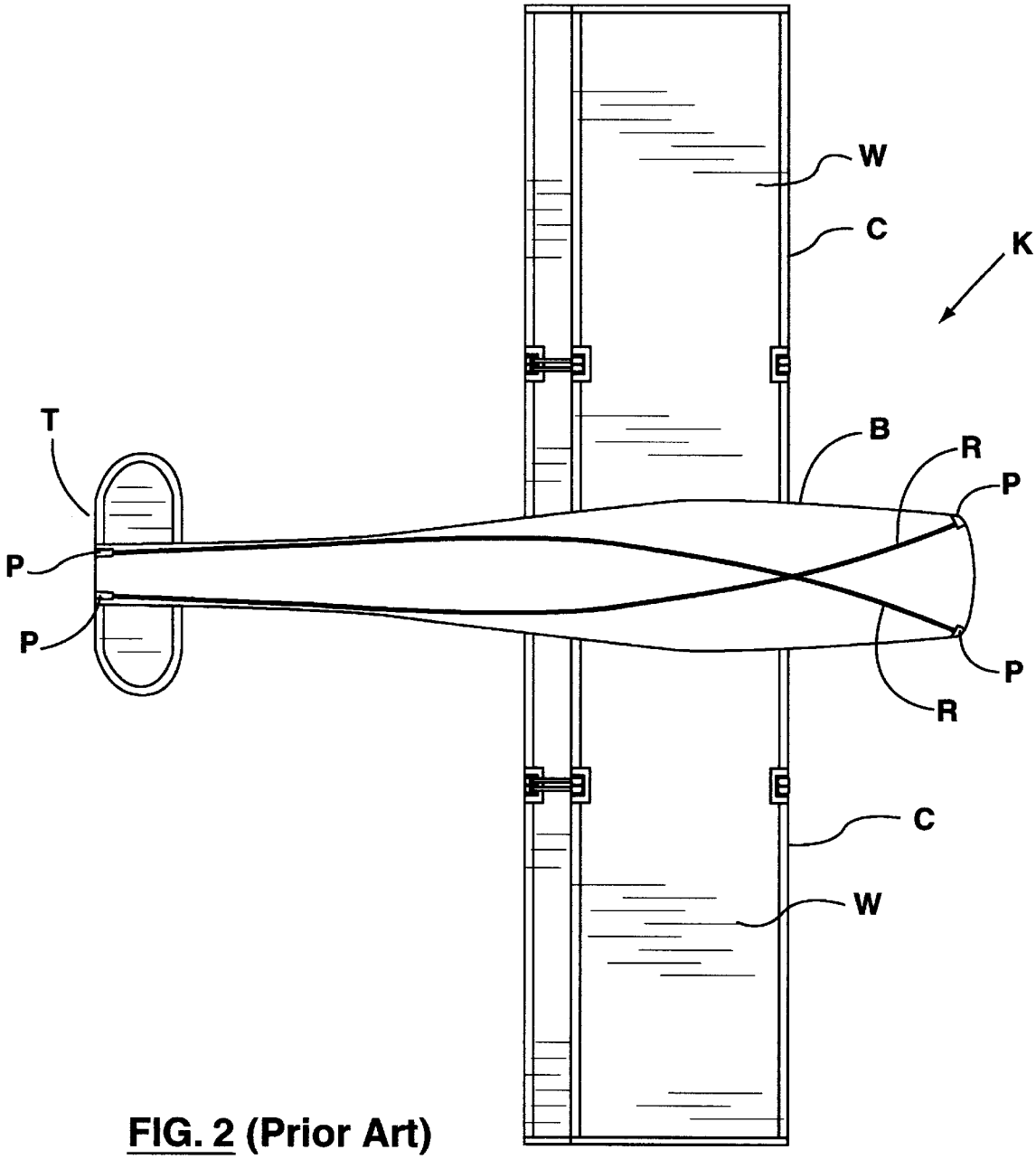
FIG. 2 (Prior Art)
FIG. 2 is a top plan view of the kite of FIG. 1, shown with a portion of the fuselage removed to show the internal structure therein.
Figure 3:
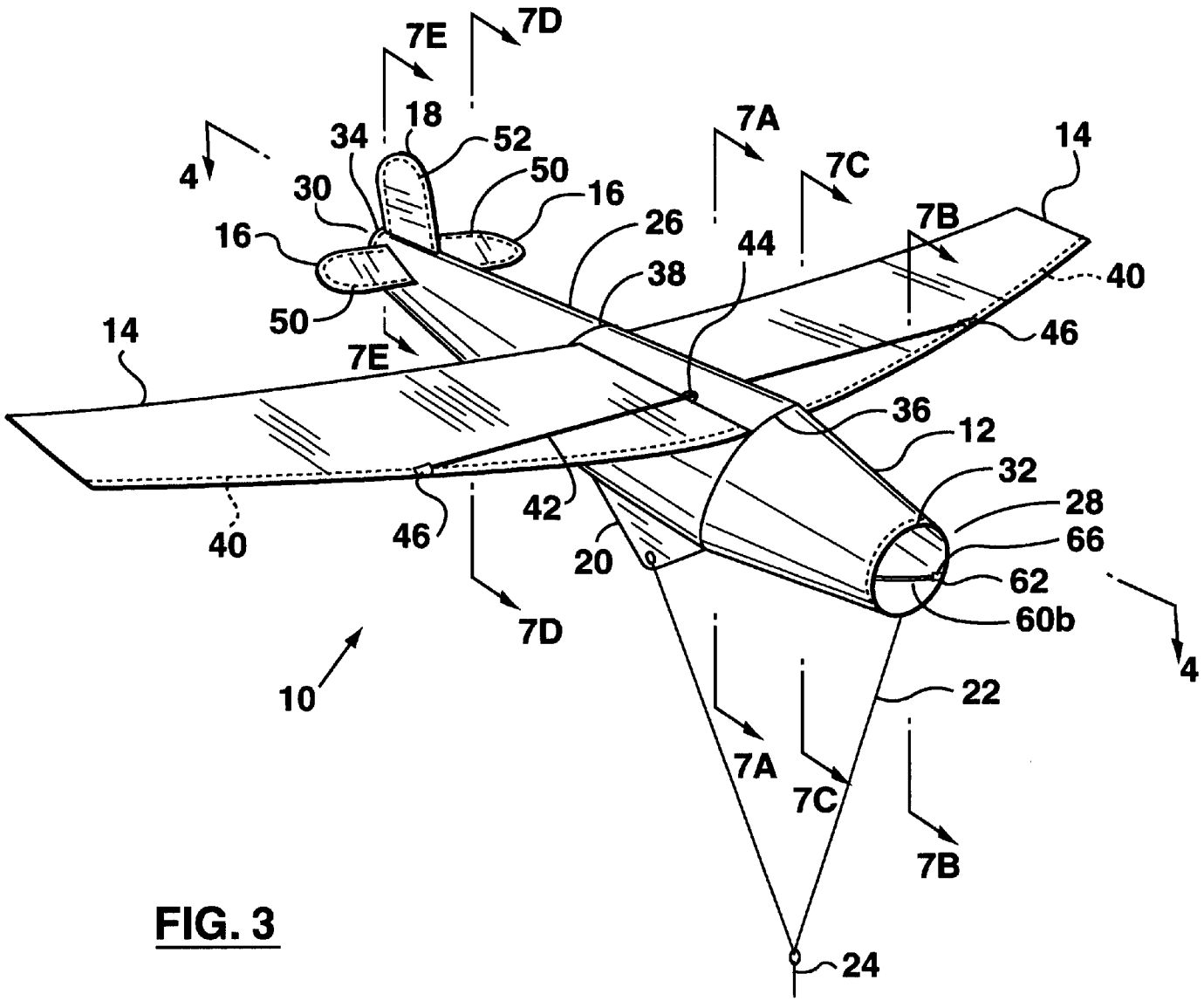
FIG. 3 is an isometric view from the front and to one side of a kite according to the present invention.

A windsock kite made in accordance with the present invention is shown in the Figures generally at 10. Referring to FIG. 3, kite 10 has a fuselage or windsock sleeve 12, wings 14, a pair of horizontal stabilizers 16 and a tail 18. A yoke 20 is provided for attachment of a bridle 22 and a kite sting 24.

Sleeve 12 has a generally cylindrical fabric body 26, having a longitudinal axis LA (see FIGS. 4 and 5), an open leading end 28 and an open trailing end 30 and sewn inside (or otherwise attached to) the sleeve fabric at ends 28 and 30 are a pair of semi-rigid or rigid rings 32 and 34 provided to maintain the openings in a desired shape, preferably circular. As will be described in more detail below, a pair of ribs 36 and 38 extend around the inner periphery of sleeve 12, at positions substantially flanking the leading and trailing edges of wings 14.

Wings 14 are attached to and extend laterally substantially perpendicularly from a mid-portion of sleeve 12. Sewn inside (or otherwise attached to) the fabric at the leading edge of each wing 14 and extending substantially along the length of the wing is a semi-rigid or rigid wing spar rod 40. Wings 14 are also supported by a cross-beam rod 42 passing through sleeve 12 at holes 44. Cross-beam rod 42 is received and retained at its ends by a pair of retaining cups 46. The length of cross-beam rod 42 is slightly longer than the distance between cups 46, such that when cross-beam rod 42 is inserted in cups 46, the fabric in wings 14 is placed under tension.

Horizontal stabilizers 16 and tail 18 are attached to and extend perpendicularly from end 30 of sleeve 12. Horizontal stabilizers 16 and tail 18 are preferably also fabric. Sewn inside an edge of (or otherwise attached to) the fabric horizontal stabilizers 16 and tail 18 are stiffeners 50 and 52, respectively, to support and maintain the shape of horizontal stabilizers 16 and tail 18.

Figure 4:
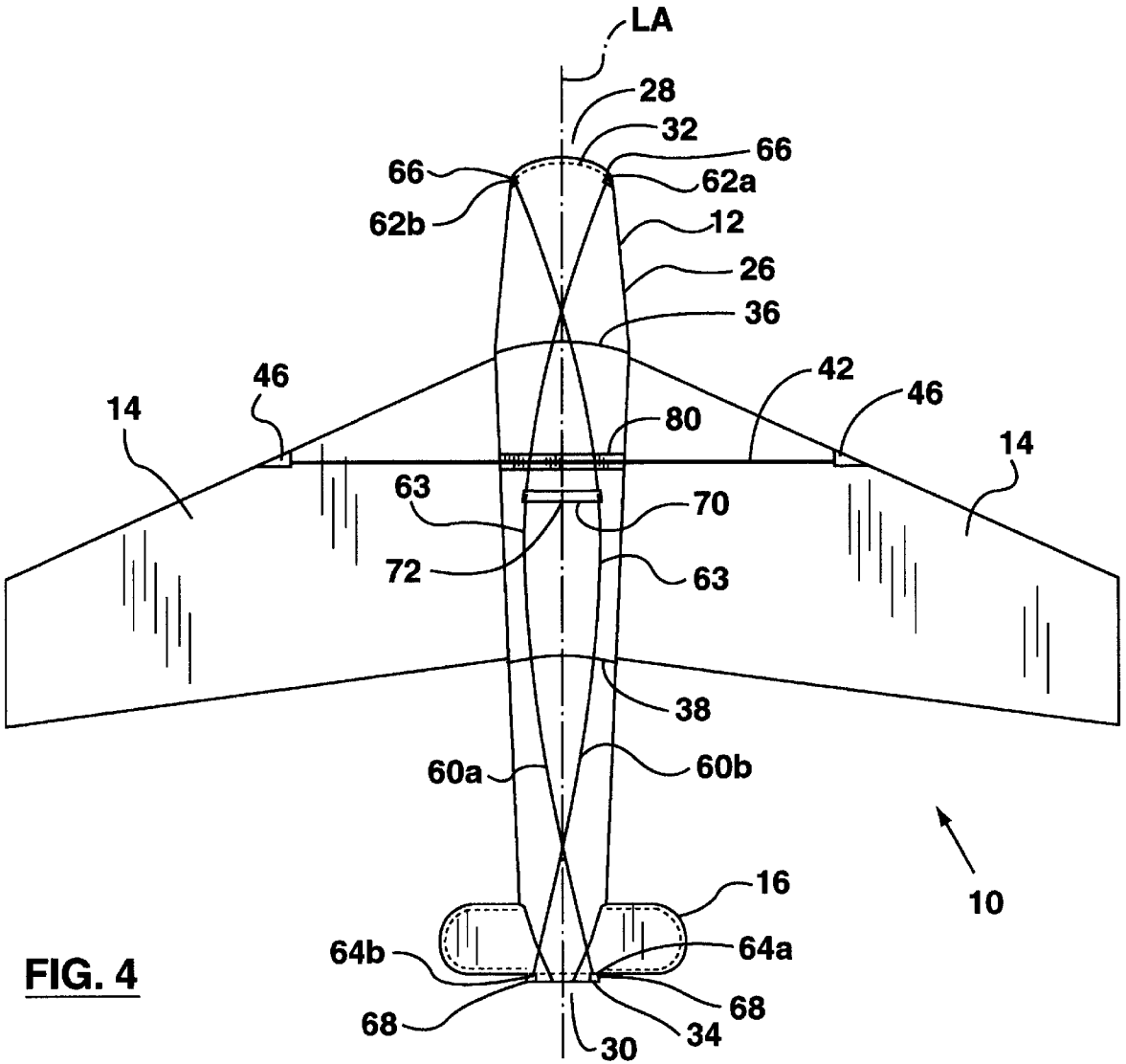
FIG. 4 is a top plan view of the kite of FIG. 3, shown with a portion of the fuselage removed to show the internal structure therein.

Referring to FIG. 4, sleeve 12 is supported internally by a pair of resilient longeron rods 60, in particular a first rod 60*a* and a second rod 60*b*, having ends 62*a*, 62*b* and 64*a*, 64*b* respectively. Ends 62*a*, 62*b* and 64*a*, 64*b* are inserted into and received by a pair of longeron retainer members or pockets 66 and 68, respectively. Longeron rods 60 have a length which is greater than that of sleeve 12, such that longeron rods 60 must curve into an area to be inserted into pockets 66 and 68. When so curved, rods 60 have an apex 63 as a result of such curvature.

Figure 5:
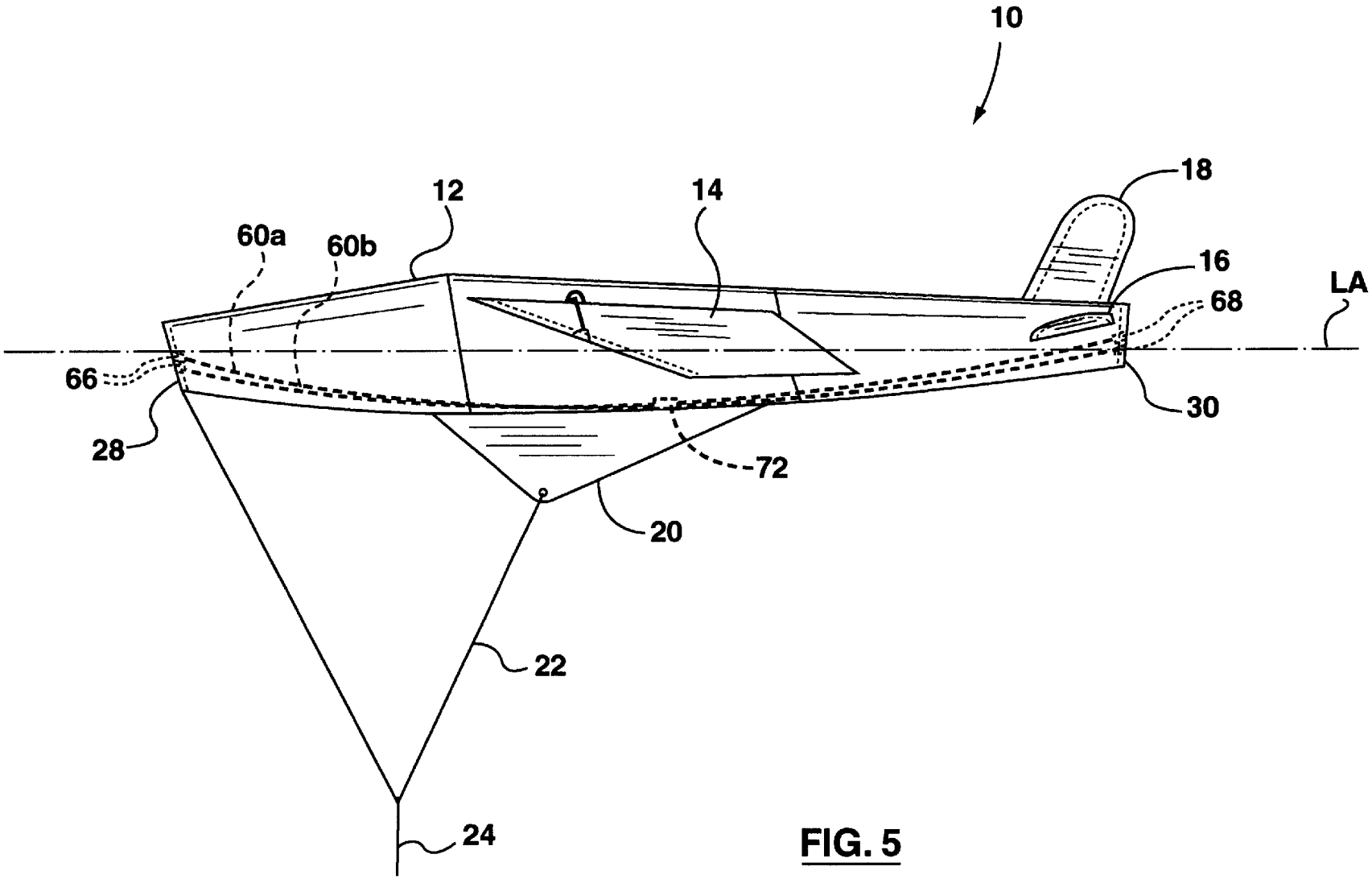
FIG. 5 is a side view of the kite of FIG. 3, shown with a portion of the fuselage removed to show the components therein.
Figure 6:
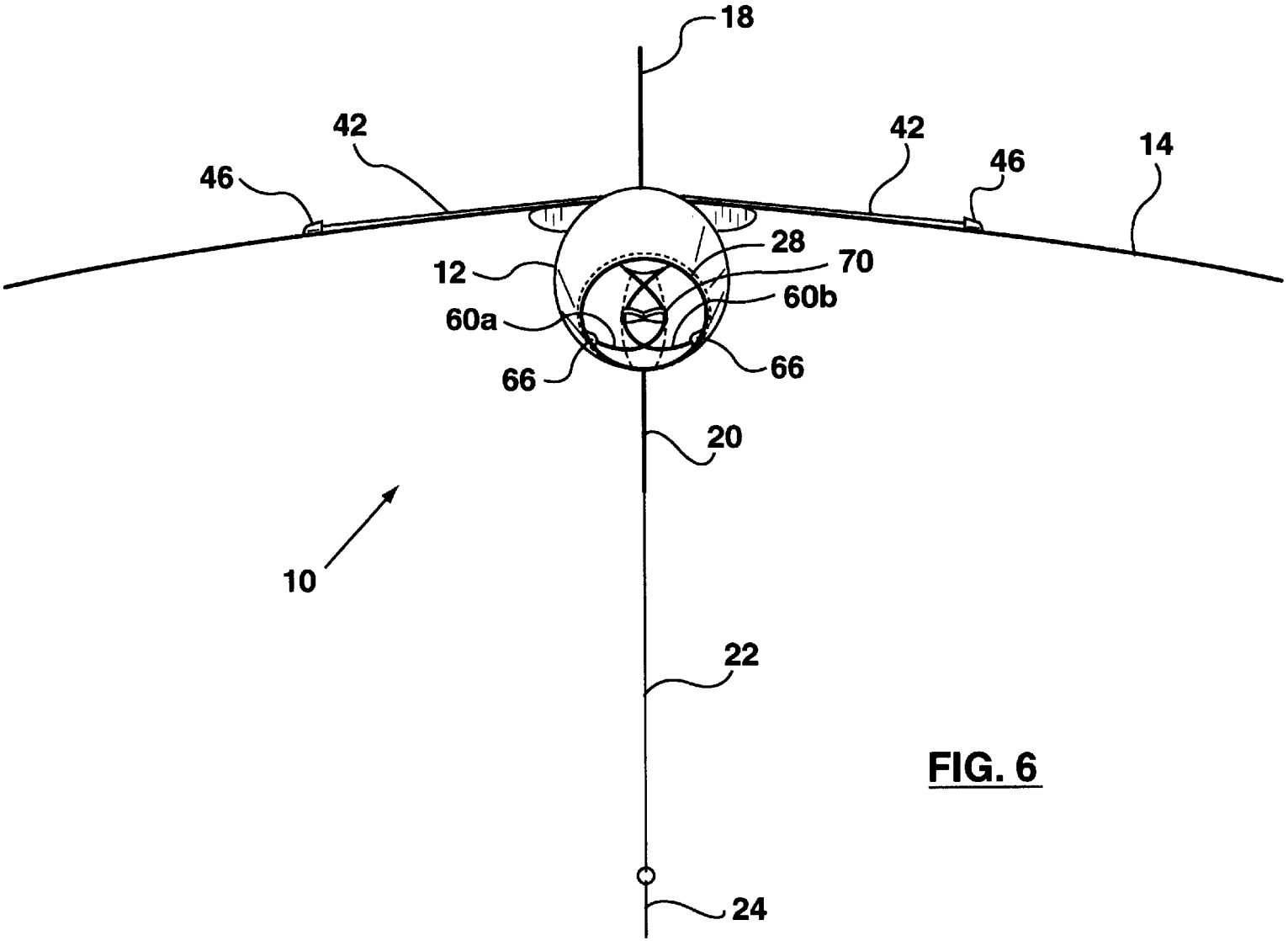
FIG. 6 is a front view of the kite of FIG. 3.

Referring to FIG. 5, pockets 66 and 68 are preferably positioned adjacent ends 28 and 30, respectively, near the position of maximum horizontal diameter of the rings. Approximately mid-way along sleeve 12 are a pair of loops 70, through which longeron rods 60 pass. Loops 70 may be simple loops fabric attached at a point 72 to sleeve 12. Loops 70 are preferably positioned to permit rods 60 to extend to a position adjacent the lateral edge of sleeve 12 (see FIGS. 4 and 7) so that apex 63 engages sleeve 12, as will be described in more detail below. Longeron rods 60 are inserted into pockets 66 and 68 such that ends 62 and 64 of a particular longeron rod 60 are located on the same side (eg. port or starboard) of kite 10. Loops 70 position and maintain a mid-portion of a longeron rod 60 substantially on the other side (eg. starboard or port) of sleeve 12 and adjacent a region of sleeve 12. Loops 70 also maintain the central, curved portion of longeron rods 60 in contact with body 26 of sleeve 12. In this configuration, when viewed substantially from a plane view (see FIG. 4) rods 60 appear to intersect, and in fact substantially intersect (see FIGS. 7C and 7D), at two locations.

Figure 7A:
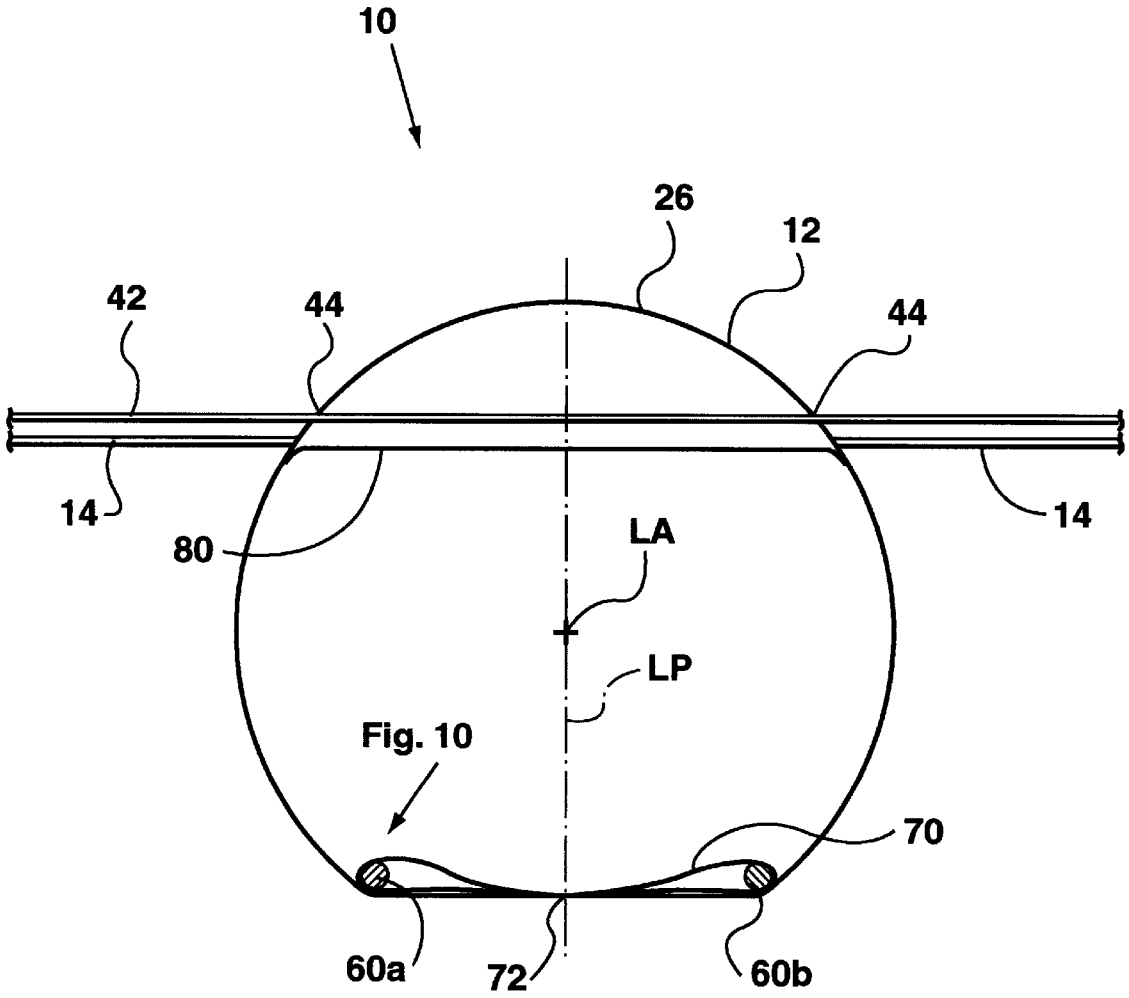
FIG. 7A is an enlarged sectional view of the kite of FIG. 3, taken along the lines 7A—7A in FIG. 3.
Figure 7B:
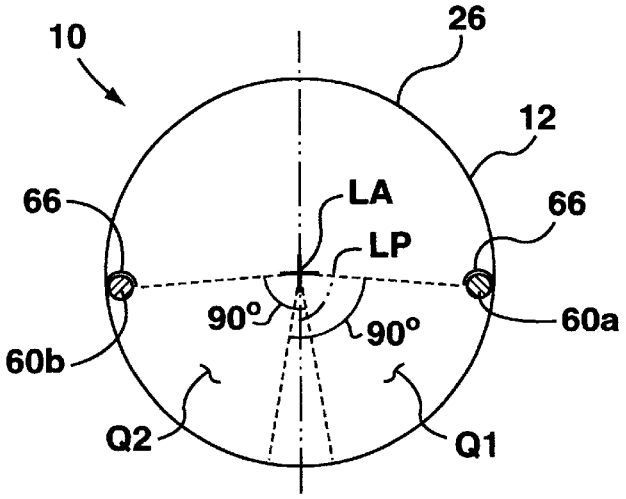
FIGS. 7B–7E are sectional views of the kite of FIG. 3, taken along the lines 7B—7B, 7C—7C, 7D—7D and 7E—7E, respectively.
Figure 7C:
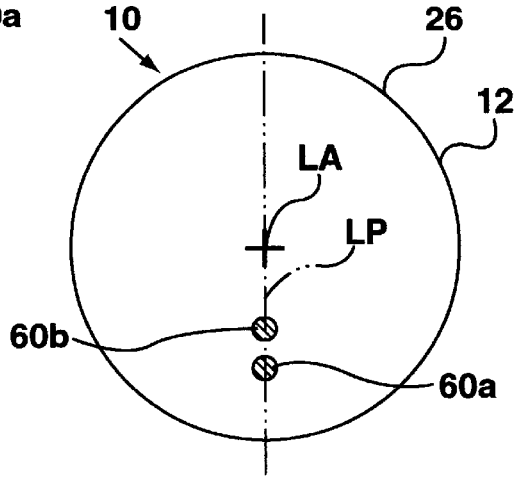
Figure 7D:
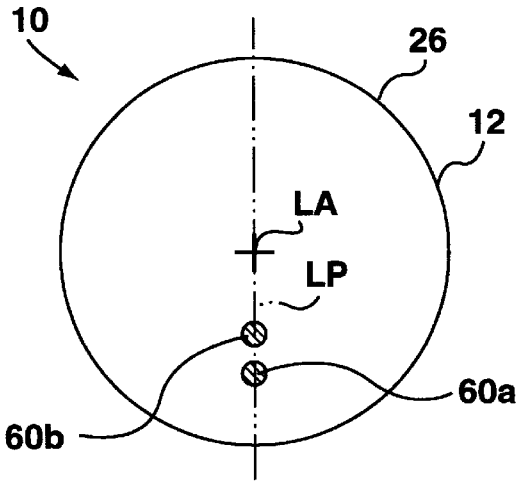
Figure 7E:
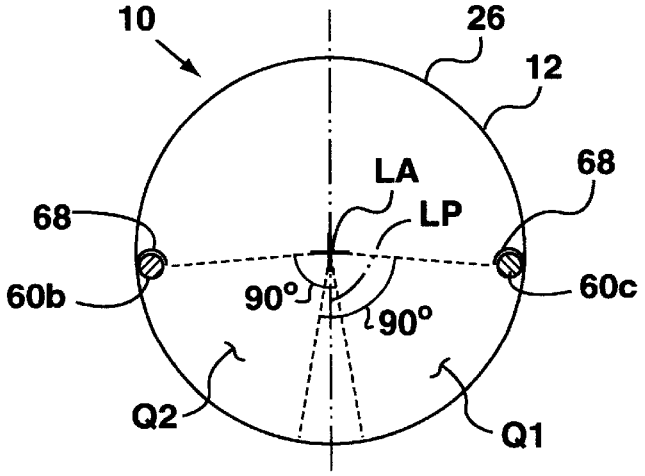

As mentioned above, the configuration of longeron rods 60*a* and 60*b* within sleeve 12 is such that ends 62*a* and 64*a* of rod 60*a* are retained on the same side of sleeve 12, and ends 62*b* and 64*b* of rod 60*b* are retained on the same side of sleeve 12. Referring to FIGS. 7A–7E, these "sides" of the sleeve 12 can be defined by a plane LP passing through the longitudinal axis LA of sleeve 12 and passing between ends 62*a* and 62*b*. Thus, ends 62*a* and 64*a* are both retained adjacent sleeve 12 on the right side (in the Figures) of the plane LP, whereas ends 62*b* and 64*b* are both retained adjacent sleeve 12 on the left side of the plane LP. Referring to FIGS. 4, 7C and 7D, it is also apparent that, by virtue of this configuration, rods 60*a* and 60*b* cross the plane LP twice. Ends 62*a*, 64*a* and 62*b*, 64*b* are thus retained within the same quadrant of the cross-section of sleeve 12. Ends 62*a* and 64*a* are retained within a quadrant Q1, defined by a 90-degree angle extending from the longitudinal axis LA, and ends 62*b* and 64*b* are retained within a quadrant Q2, also defined by a 90-degree angle extending from the longitudinal axis LA. In three dimensions, the quadrants Q1 and Q2 form longitudinal sections along the length of sleeve 12.

Figure 10:
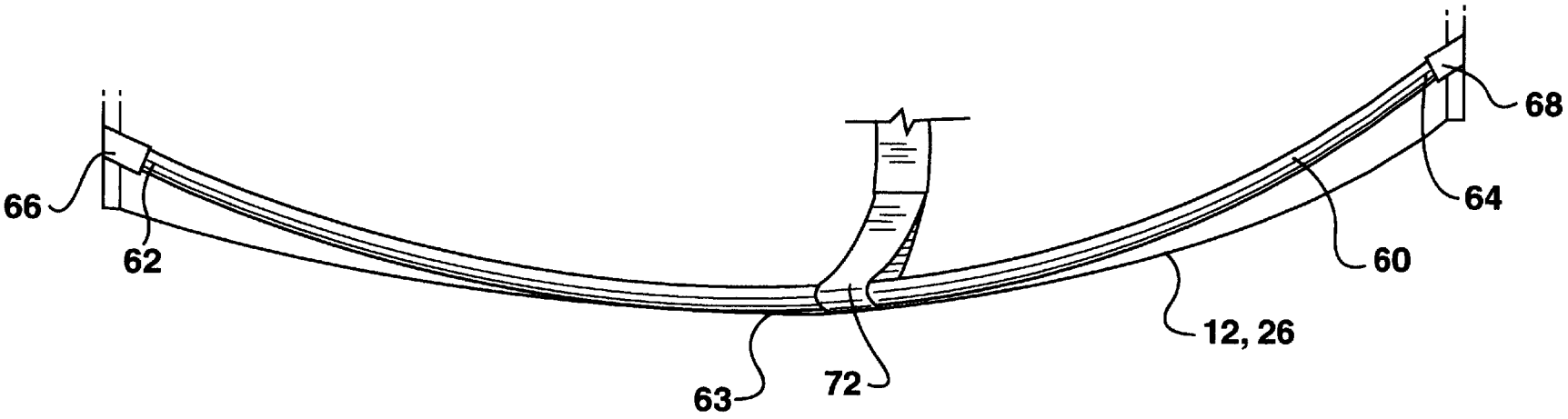
FIG. 10 is a partial side view of the kite of FIG. 3, viewed from Arrow 10 in FIG. 7A.

Thus when so positioned, apex 63 of longeron rods 60 apply an outward or transverse force over a region of fabric body 26 while the ends 62, 64 simultaneously apply a longitudinal, tensile force to the sleeve. Referring to FIG. 10, the extent of the region over which the apex of the longeron rods apply an outward, transverse force on the sleeve body depends on the length of the sleeve relative to the rod length. It is preferable for the apex area of the rods to engage the fabric over at least approximately one third of the length of the sleeve body. Thus, longeron rods 60 arranged in this configuration provide a firm support for body 26, thereby keeping body 26 substantially taut thereover and assisting to maintain a smooth outer appearance to sleeve 12. Ribs 36 and 38 also assist to further remove slack from the fabric body 26 of sleeve 12, thereby enhancing the aircraft fuselage-like appearance of sleeve 12.

Referring to FIG. 7, kite 10 also has a cross-strap 80 attached to the interior of sleeve 12 adjacent holes 44. Cross-strap 80 is preferably positioned to be aligned adjacent cross-beam 42, preferably substantially inextensible and preferably has a length substantially equal to the chord length distance between holes 44 when sleeve 12 has a circular crosssection. Cross-strap 80 prevents the deformation of the sleeve's crosssection in response to tension induced by cross-beam 42 and transmitted by wings 14 to sleeve 12. Together with ribs 36 and 38, cross-strap 80 helps to maintain a substantially circular cross-section to sleeve 12, to maintain the appearance of an aircraft fuselage.

Figure 8:
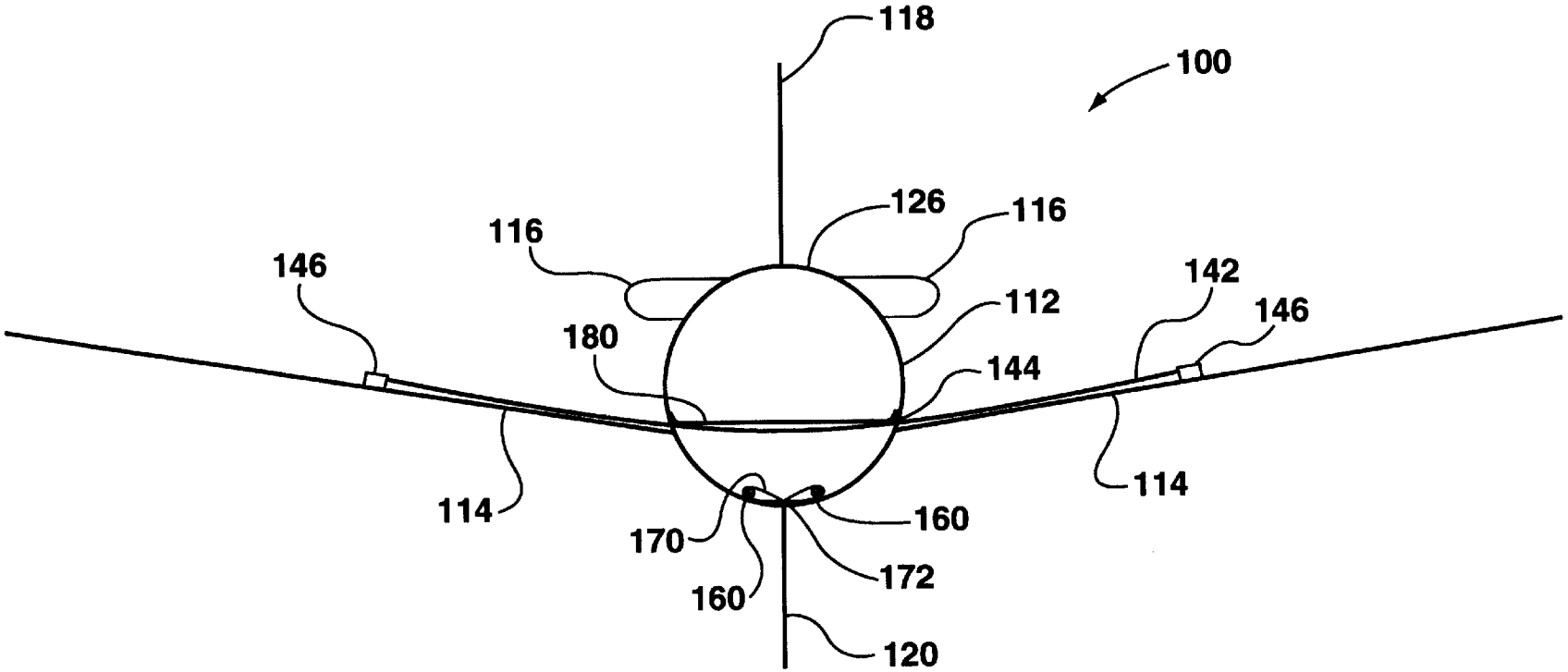
FIG. 8 is a cross-sectional view, viewed from the front towards the tail, of an alternate embodiment of a kite according to the present invention.

Referring to FIG. 8, an alternate embodiment according of the present invention is shown. In this embodiment, kite 100 comprises a body 112 and wings 114 supported by a cross-beam rod 142. Sleeve 126 is supported internally by a pair of longeron rods 160, retained centrally by loops 170. A cross-strap 180 is provided between wings 114. This embodiment is substantially similar to that of FIG. 3, with the exception that the wings are positioned vertically lower on the fuselage. It will be apparent to one skilled in the art that the positioning of the wings relative to the fuselage is not critical to the operation of the longeron rods in the configuration of the present invention. Indeed, one will understand that an advantage is derived from the present invention irrespective of whether the kite has airplane-type wings, other types of wings or lacks wings altogether.

Figure 9:
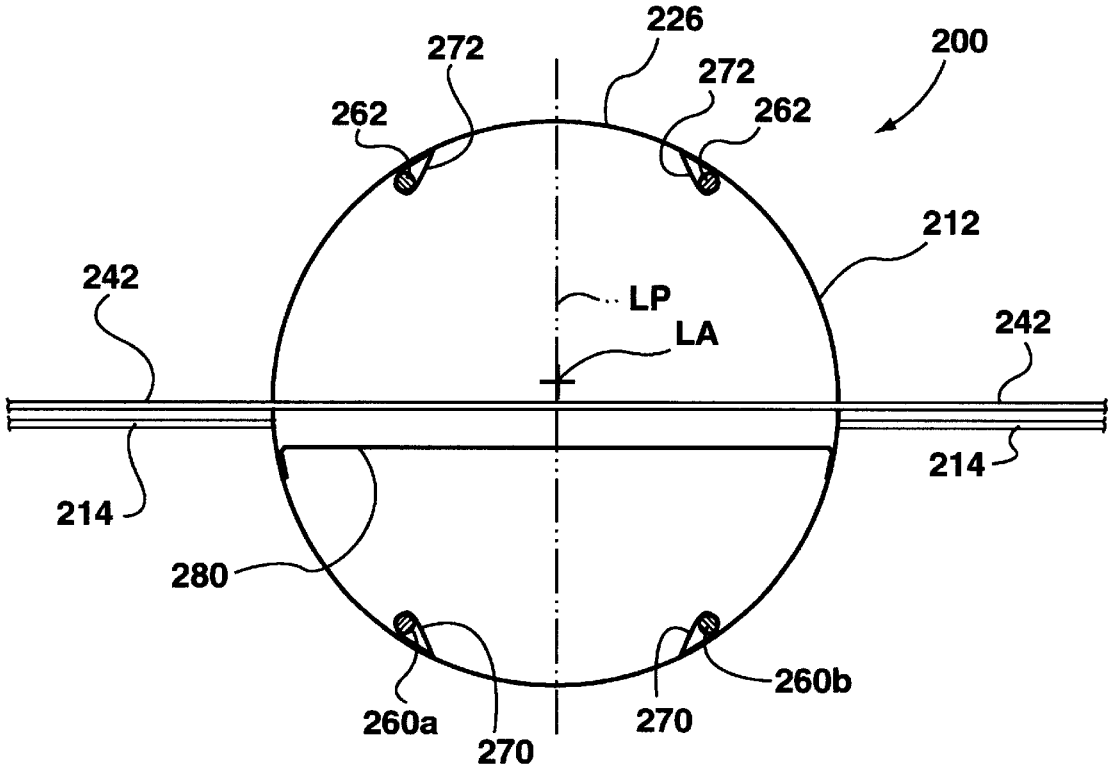
FIG. 9 is a cross-sectional view of a further alternate embodiment of the kite according to the present invention.

Referring to FIG. 9, a further alternate embodiment according of the present invention is shown. In this embodiment, kite 200 comprises a body 212 and wings 214 supported by a cross-beam rod 242. Sleeve 226 is supported internally by a pair of longeron rods 160, retained centrally by loops 170 and a further pair of longeron rods 262, retained by loops 272. A cross-strap 280 is provided between wings 114. This embodiment is substantially similar to that of FIG. 3, with the exception that an increased number of longeron rods is provided to maintain a desired shape of body 212. It will be understood by one skilled in the art that numerous variations to the configuration and number of longeron rods can be made without departing from the scope of the present invention. Through such variation, a wide variety of body shapes is available to the kite designer. Further, it will be apparent from FIG. 9 that the configuration of loop 70, 270 is not important to the present invention and any means of maintaining the position of the mid-portion of a longeron rod adjacent the fabric body of the sleeve will suffice in achieving the present invention. For example, plastic hooks or clips may equally be used in place of loops 70 or 270, 272. Further, it will be understood that, while means for retaining the longeron rods in place are desirable to stabilize the structure, such means may also be omitted altogether, if desired, without departing from the scope of the present invention.

Through such variation, a wide variety of body shapes is available to the kite designer. Further, it will be apparent from FIG. 9 that the configuration of loop 70, 270 is not important to the present invention and any means of maintaining the position of the mid-portion of a longeron rod adjacent the fabric body of the sleeve will suffice in achieving the present invention. For example, plastic hooks or clips may equally be used in place of loops 70 or 270, 272. Further, it will be understood that, while means for retaining the longeron rods in place are desirable to stabilize the structure, such means may also be omitted altogether, if desired, without departing from the scope of the present invention.

The arrangement of the longeron rods according to the present invention substantially improves the stability and shape-retaining characteristics of a windsock kite over prior art internal support arrangements. The present invention provides a surprisingly stable yet simple structure. The simplicity of the design is especially important in permitting an inexpensive and yet easy-to-assemble design for such a kite. By retaining the rod ends on the same side of the sleeve at both ends, a smaller radius of curvature is achieved than in the rods of the prior art. The increased curvature increases the tension exerted by the curved rod on the sleeve, while simultaneously providing a fuller, more sleeve-filling curve for a given rod-to-sleeve length ratio than the prior art. The result is a more stable structure having a more aesthetic appearance than the prior art.

Further, the cross-strap means of the present invention permits the flexible fabric of the sleeve body to maintain its shape while still transmitting a tensile force therethrough and, thus, permits the kite to maintain a desired overall outer appearance, such as an airplane, while remaining functional. That shape may be yet further enhanced by the use of the peripheral stiffening ribs of the present invention.

It will be understood that any number and arrangement of longeron can be employed without departing from the scope of the present invention and the present invention is not limited to two such rods. Further, it will be understood that any means of maintaining the positioning or the longeron rods in the sleeve may be used, and need not necessarily be restricted to the loop means (70) of the preferred embodiment. Other means may equally be provided, or such means may be omitted altogether, if desired. One skilled in the art will also understand that the present invention is not limited to use with airplane-like kites, but may also be used with advantage on any kite having a hollow, sleeve-like body. Such body may have open ends (28, 30) as described above, or the body may equally have one or both ends partially or completely closed or sealed. The shape of such body need not be substantially cylindrical, but may be any oblong shape (ie. having a length substantially greater than its cross-section) desired.

While the above description constitutes the preferred embodiment, it will be appreciated that the present invention is susceptible to modification and change without parting from the fair meaning of the proper scope of the accompanying claims.

I claim:

1. A kite comprising:

(a) a fabric sleeve having a leading end, a trailing end and a generally longitudinal axis extending from said leading end to said trailing end;

(b) at least one wing member mounted to said sleeve;

(c) at least two resilient rods, each of said rods having a leading end and a trailing end; and (d) a plurality of rod retainers for retaining said rods so that said rods add support to said sleeve, said rods, when retained in said rod retainers, having a curved configuration and extending generally longitudinally of said sleeve, wherein each rod contacts said sleeve at at least one region between said sleeve leading end and said sleeve trailing end, and wherein said rods intersect, at least twice, at least one plane defined by said general longitudinal axis and extending between said respective first ends of said rods.

2. The kite of claim 1 further comprising at least one loop member for retaining a mid-portion of one of said rods adjacent said sleeve.

3. The kite of claim 1 wherein said kite has the appearance of an airplane.

4. The kite of claim 1 wherein said sleeve is a windsock.

5. The kite of claim 1 wherein said sleeve has at least one open end.

6. The kite of claim 1 further comprising at least one rib member for maintaining said fabric sleeve in a substantially taut condition, said rib member extending along a portion of the circumference of said sleeve.

7. The kite of claim 1 further comprising at least one substantially inextensible strap member having two ends, each of said ends attached to said sleeve, said strap positioned interior of said sleeve for transferring a tensile force between said strap ends.

8. The kite of claim 7 further comprising two wing members attached to said sleeve and wherein said strap member is positioned interior of said sleeve substantially between said wing members.

9. A kite comprising:

(a) a fabric sleeve;

(b) at least one wing member mounted to said sleeve;

(c) at least two resilient rods for internally supporting said sleeve; and (d) a plurality of rod retainers for retaining said rods interior of said sleeve in a curved condition, wherein when said at least two rods are retained in said retainers one of said rods substantially intersects another one of said rods at least twice.

10. The kite of claim 9 further comprising at least one loop member for retaining a mid-portion of one of said rods adjacent said sleeve.

11. The kite of claim 9 wherein said kite has the appearance of an airplane.

12. The kite of claim 9 wherein said sleeve is a windsock.

13. The kite of claim 9 wherein said sleeve has at least one open end.

14. The kite of claim 9 further comprising at least one rib member for maintaining said fabric sleeve in a substantially taut condition, said rib member extending along a portion of the circumference of said sleeve.

15. The kite of claim 9 further comprising at least one substantially inextensible strap member having two ends, each of said ends attached to said sleeve, said strap positioned interior of said sleeve for transferring a tensile force between said strap ends.

16. The kite of claim 15 further comprising two wing members attached to said sleeve and wherein said strap member is positioned interior of said sleeve substantially between said wing members.

17. A kite comprising:

(a) a fabric sleeve;

(b) at least one wing member mounted to said sleeve;

(c) at least a first and second resilient rods for internally supporting said sleeve; and (d) a plurality of rod retainers for retaining said rods interior of said sleeve in a curved condition, wherein when said first and second rods are retained in said retainers, said first rod substantially intersects said second rod in at least two different locations along the length of said first rod.

18. The kite of claim 17 further comprising at least one loop member for retaining a mid-portion of one of said rods adjacent said sleeve.

19. The kite of claim 17 further comprising at least one rib member for maintaining said fabric sleeve in a substantially taut condition.

20. The kite of claim 17 further comprising at least one substantially inextensible strap member having two ends, each of said ends attached to said sleeve, said strap positioned interior of said sleeve for transferring a tensile force between said strap ends.

* * * * *